US009440819B2

(12) United States Patent
Rossignol

(10) Patent No.: US 9,440,819 B2
(45) Date of Patent: Sep. 13, 2016

(54) ENERGY MANAGEMENT SYSTEM FOR ELEVATOR INSTALLATION

(75) Inventor: Eric Rossignol, Magadino (CH)

(73) Assignee: Inventio AG, Hergiswil (CH)

( * ) Notice: Subject to any disclaimer, the term of this patent is extended or adjusted under 35 U.S.C. 154(b) by 400 days.

(21) Appl. No.: 14/005,890

(22) PCT Filed: Mar. 7, 2012

(86) PCT No.: PCT/EP2012/053858
§ 371 (c)(1),
(2), (4) Date: Sep. 18, 2013

(87) PCT Pub. No.: WO2012/126728
PCT Pub. Date: Sep. 27, 2012

(65) Prior Publication Data

US 2014/0008155 A1 Jan. 9, 2014

(30) Foreign Application Priority Data

Mar. 18, 2011 (EP) ..... 11158872

(51) Int. Cl.
*B66B 1/06* (2006.01)
*B66B 1/30* (2006.01)

(52) U.S. Cl.
CPC ..... *B66B 1/302* (2013.01)

(58) Field of Classification Search
CPC ..... B66B 1/302
USPC ..... 187/247, 289, 290, 391, 393; 318/139, 318/362, 376, 377; 307/64, 66
See application file for complete search history.

(56) References Cited

U.S. PATENT DOCUMENTS

| | | | | |
|---|---|---|---|---|
| 5,896,948 | A * | 4/1999 | Suur-Askola | B66B 1/30 187/290 |
| 6,827,182 | B2 * | 12/2004 | Araki | B66B 5/027 187/290 |
| 7,540,355 | B2 * | 6/2009 | Harkonen | B66B 1/302 187/290 |
| 7,554,278 | B2 * | 6/2009 | Wegner-Donnelly | B66C 13/18 187/277 |
| 7,681,694 | B2 * | 3/2010 | Aulanko | B66B 1/302 187/277 |
| 8,172,042 | B2 * | 5/2012 | Wesson | B66B 1/308 187/290 |
| 8,622,177 | B2 * | 1/2014 | Acquaviva | B66B 1/302 187/285 |
| 2010/0044160 | A1 * | 2/2010 | Agirman | B66B 5/027 187/290 |

(Continued)

FOREIGN PATENT DOCUMENTS

| | | | |
|---|---|---|---|
| CN | 101618825 | A | 1/2010 |
| WO | 9825849 | A1 | 6/1998 |

*Primary Examiner* — Anthony Salata
(74) *Attorney, Agent, or Firm* — Fraser Clemens Martin & Miller LLC; William J. Clemens

(57) ABSTRACT

An energy management system for an elevator installation coupled to a source of alternative energy integrates various operational modes regarding optimization of energy usage. The energy management system selectively executes these modes depending on at least one predetermined parameter of a variety of parameters. The energy management system has a processor and a switch module coupled to the processor to receive a control signal from the processor. Upon processing of at least one of the parameters, the processor selects one of a plurality of operational modes of the elevator installation and generates the control signal as a function of the selected operational mode to cause via the switch module an energy flow from one of the inputs of the switch module to the output of the switch module.

16 Claims, 9 Drawing Sheets

(56) References Cited

U.S. PATENT DOCUMENTS

2014/0116810 A1* 5/2014 Vrankovic ..... B66B 1/302 187/290
2014/0166407 A1* 6/2014 Sonnenmoser ..... B66B 1/2408 187/276
2015/0122589 A1* 5/2015 Mezzadri ..... B66B 1/306 187/290
2015/0203328 A1* 7/2015 Horbrugger ..... B66B 1/302 187/290
2016/0083220 A1* 3/2016 Agirman ..... H02J 7/02 187/290

* cited by examiner

Legend
2: elevator installation
4a: solar panels
5: building
5a: roof
8: car
10: floors
12: drive motor
14: control system
16: floor terminals
18: suspension medium
20: car terminal
21: display devices

ENERGY MANAGEMENT SYSTEM FOR ELEVATOR INSTALLATION

FIELD

The various embodiments of the innovation described herein relate generally to elevator installations, in particular to installations that are coupled to an alternative source of electrical energy, such as a photovoltaic system. More specifically, these embodiments of the innovation relate to an energy management system for such elevator installations. Furthermore, these embodiments relate to a method of operating an elevator installation that is coupled to an alternative source of electrical energy.

BACKGROUND

In the planning phase of a building, the building owner and the architect need to decide whether or not an elevator installation is to be installed in the building. During that process, building owners and architects increasingly consider parameters such as energy consumption, eco-friendliness and overall operational costs of elevator installations. In certain countries, the reliability of the public power grid is an additional parameter since power outages may shut down an elevator installation leaving it unavailable during a power outage.

Several approaches that address some of these considerations are known. For example, JP 4-272073 discloses a "clean" elevator system having solar cells that charge a battery. The battery provides energy for driving a motor of the elevator system. In addition, the battery absorbs regenerated energy provided by the motor when is acts as a power generator.

Also, CN101544332 describes an elevator system powered by a switchable power supply. The elevator system has a commercial power supply, a power supply input identification interface, an intelligent power supply controller, a power supply output identification interface, an elevator driving controller, a solar energy generating device and an energy storage. The solar energy generating device is connected with the power supply input identification interface and the energy storage; and the energy storage is connected with the power supply input identification interface and the elevator driving controller. The elevator is powered by a stand-by power supply supplied by the solar energy generating device, wherein the energy storage stores the electrical energy to ensure that the elevator runs normally in case that the commercial power supply is cut off.

Even though these approaches address some of the parameters building owners and architects increasingly consider, they are individual approaches and provide as such limited flexibility and adaptability to various circumstances. There is, therefore, a need for an alternative approach with improved flexibility and adaptability. Accordingly, the various embodiments of such an alternative approach disclosed herein relate to an energy management system, in which various operational modes regarding optimization of energy usage are integrated and which selectively executes these modes depending on at least one predetermined parameter of a variety of parameters.

SUMMARY

One aspect of the innovation is an energy management system for an elevator installation coupled to a source of alternative energy, wherein the energy management system includes a processor and a switch module. The processor has a first input for coupling to an electrical energy storage device to obtain a parameter indicative of a charge status of the electrical energy storage device, a second input for coupling to the source of alternative energy to obtain a parameter indicative of power available from the source of alternative energy, a third input for coupling to an electrical power grid to obtain a parameter indicative of a status of the power grid, and a fourth input for coupling to a controller of the elevator installation to obtain a parameter indicative of an operation of the elevator installation. The switch module is coupled to the processor to receive a control signal from the processor, and has a first input for coupling to the electrical energy storage device, a second input for coupling to the source of alternative energy, and a third input for coupling to the electrical power grid. The switch module has an output for coupling a drive motor of the elevator installation to one of the electrical energy storage device, the source of alternative energy and the electrical power grid. The processor is configured to process at least one of the parameters to select one of a plurality of operational modes of the elevator installation and to generate the control signal as a function of the selected operational mode to cause an energy flow from one of the inputs of the switch module to the output of the switch module.

Another aspect of the innovation is a system including an elevator installation having a drive motor and an elevator controller, a source of alternative energy coupled to an electrical energy storage device, and an energy management system having a processor and a switch module coupled to the processor to receive a control signal from the processor. The processor has a first input for coupling to an electrical energy storage device to obtain a parameter indicative of a charge status of the electrical energy storage device, a second input for coupling to the source of alternative energy to obtain a parameter indicative of power available from the source of alternative energy, a third input for coupling to an electrical power grid to obtain a parameter indicative of a status of the power grid, and a fourth input for coupling to a controller of the elevator installation to obtain a parameter indicative of an operation of the elevator installation. The switch module has a first input for coupling to the electrical energy storage device, a second input for coupling to the source of alternative energy, a third input for coupling to the electrical power grid and an output for coupling a drive motor of the elevator installation to one of the electrical energy storage device, the source of alternative energy and the electrical power grid. The processor is configured to process at least one of the parameters to select one of a plurality of operational modes of the elevator installation and to generate the control signal as a function of the selected operational mode to cause an energy flow from one of the inputs of the switch module to the output of the switch module.

Furthermore, one aspect of the innovation is a method of managing energy for an elevator installation. The method processes at least one parameter of a group comprising a parameter indicative of a charge status of the electrical energy storage device, a parameter indicative of power available from the source of alternative energy, a parameter indicative of a status of the power grid, and a parameter indicative of an operation of the elevator installation. In response to the processing, the method selects one of a plurality of operational modes of the elevator installation, and generates a control signal for a switch module as a function of the selected operational mode to cause an energy flow from one of the ports of the switch module to another port of the switch module.

In certain embodiments, the above system or energy management system may not have an input for coupling to a power grid. In such an embodiment, the elevator installation is exclusively provided with energy from the source of alternative energy or the electrical energy storage device (battery system), or both.

One advantage is that the energy management system can detect via the parameter indicative of an operation of the elevator installation that a drive motor of the elevator installation is in a regenerative mode, and can then control the switch module to allow energy flow from the output to one of the first input and the third input of the switch module. However, it is contemplated that such a regenerative mode is optional and may not be present in all embodiments.

Another advantage is that the energy management system can detect via at least the parameter indicative of power available from the source of alternative energy that a surplus of alternative energy is available, and can then control the switch module to allow energy flow from the second input to the third input of the switch module so that alternative energy is fed back to the power grid. This may also be an optional feature and may not be present in all embodiments.

A further advantage is that the energy management system can detect via the parameter indicative of an operation of the elevator installation that the elevator installation is in a standby mode, and can then control the switch module to supply energy from one of the first input and the second input of the switch module to the elevator controller.

In one embodiment, the system has a voltage converter coupled between the energy management system and the electrical energy storage device. The voltage converter is configured to convert a predetermined voltage provided via a DC link to a voltage adapted to a predetermined voltage of the electrical energy storage device, and/or to convert the predetermined voltage of the electrical energy storage device to the predetermined voltage of the DC link. Advantageously, the voltage conversion may be uni-directional or bi-directional.

Advantageously, flexibility regarding the kind of power grid is provided by a charge device (e.g., a battery charger). The charge device is coupled to the electrical energy storage device and the power grid to charge the electrical energy storage device with energy from the power grid, wherein the power grid is a one-phase power grid or a three phase power grid.

DESCRIPTION OF THE DRAWINGS

The novel features and method steps characteristic of the innovation are set out in the claims below. The innovation itself, however, as well as other features and advantages thereof, are best understood by reference to the detailed description, which follows, when read in conjunction with the accompanying drawings, wherein:

DETAILED DESCRIPTION

Figure 1:
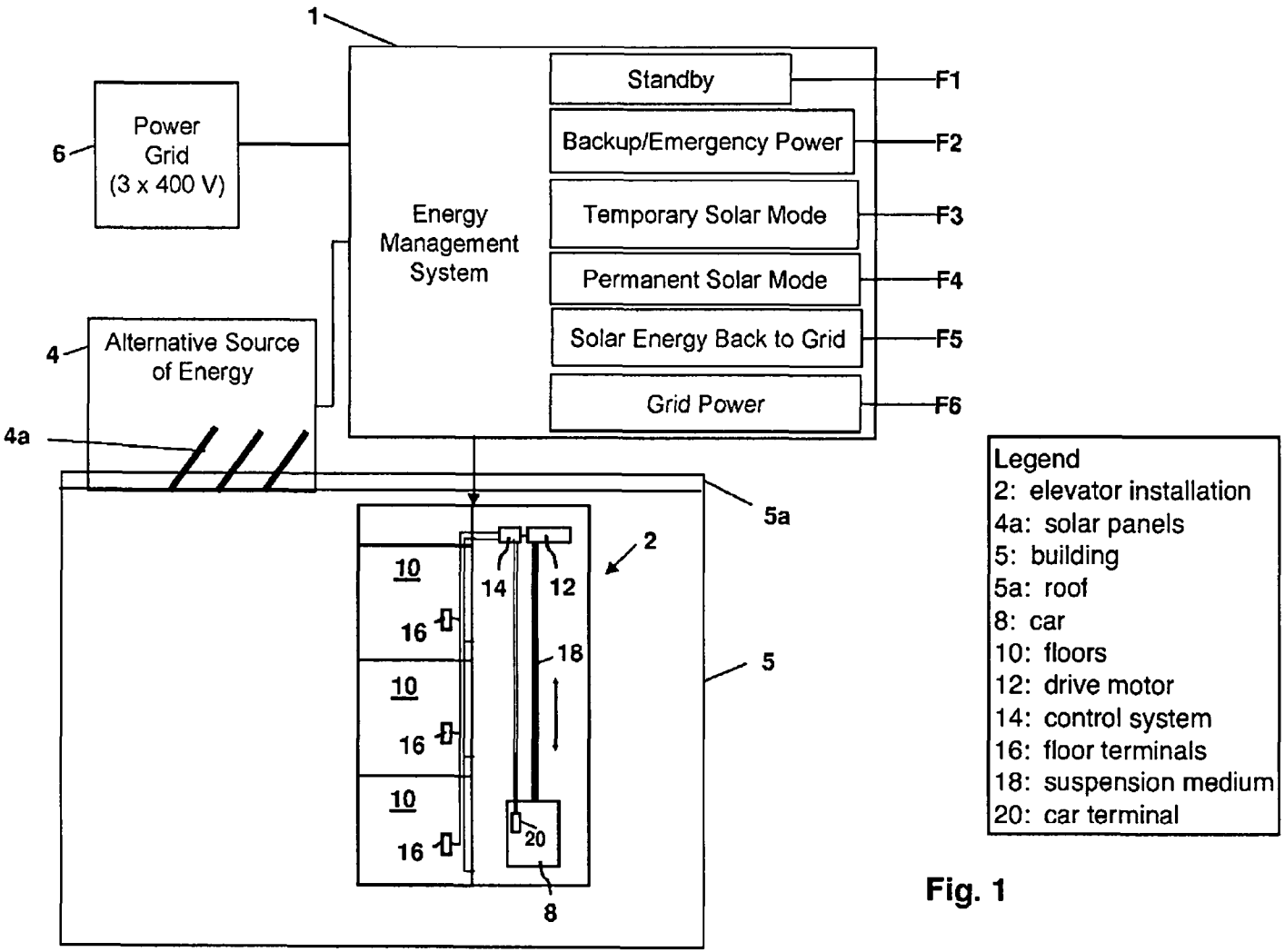
FIG. 1 schematically illustrates interactions and functions of an exemplary energy management system of one embodiment of an elevator installation in a building.

FIG. 1 schematically illustrates interactions and functions of an energy management system 1 of an elevator installation 2 installed in a building 5. The energy management system 1 is coupled to a source of alternative energy 4 and a power grid 6, e.g., a three-phase 400 volts (3×400 V) system. Briefly, the energy management system 1 is configured to select one of several operational modes, which are defined through functions F1-F6, as a function of various parameters (e.g., status of the source of alternative energy 4, status of the power grid 6, operational parameters of the elevator installation, day and time, and pre-defined routines) to operate the elevator installation 2. The energy management system 1, therefore, allows for a flexible and dynamic setting of an operational mode, which results, e.g., in optimized energy consumption and overall operational costs, and improved availability of the elevator installation 2.

For ease of illustration, the energy management system 1 is shown in FIG. 1, as well as in the following figures, as being apart from and coupled to the elevator installation 2. It is, however, contemplated that the energy management system 1 is usually a part of the elevator installation 2; it may be an integral (central) part of a control system of the elevator installation 2, or it may be a decentralized part of the control system. Further, certain functionalities may be shared with other hardware or software components of the elevator installation 2, or be provided by other hardware or software components as long as the overall functionality of the energy management system 1, i.e., to manage energy within the elevator installation 2, warranted.

The exemplary elevator installation 2 of FIG. 1 serves (e.g., three) floors 10 of the building 5 and includes a car 8, a control system 14, a drive having a drive motor 12, floor terminals 16 and a car terminal 20. At least one suspension medium 18 connects the car 8 to the drive. The drive is configured to drive the suspension medium 18 to move the cabin 8 up and down a hoistway or shaft. In one embodiment, the elevator installation 1 is a traction-type elevator, i.e., a drive sheave coupled to the drive motor 12 acts upon the suspension medium 18 by means of traction between the drive sheave and the suspension medium 18. In such an embodiment, the suspension medium 18 serves as a suspension and traction medium.

In one embodiment, the suspension medium 18 has a belt-type configuration in which several cords of metallic material are fully or partially embedded in an elastomeric coating. That configuration has a cross-section having a width that is longer than its height. The surface of such a suspension medium 18 may be flat or have longitudinal grooves. In another embodiment of a suspension medium 18 with such a cross-section, cords of non-metallic material, such as aramid fibers, are fully or partially embedded in an elastomeric material. In yet another embodiment, the suspension medium 18 may have a round configuration in which individual cords of metallic or non-metallic material are twisted to a rope. Such a round suspension medium may be uncoated or coated with an elastomeric material.

It is contemplated that application of the energy management system 1 is not limited to a particular type of elevator installation 2 or suspension medium 18. For example, one of ordinary skill in the art will appreciate that the energy management system 1 described herein can be used not only with a traction-type elevator, with round or flat suspension media 18, but also with other types of elevators, e.g., hydraulic elevators.

In the various embodiments described herein, the source of alternative energy 4 includes a photovoltaic system positioned on a roof 5*a* of the building 5. The photovoltaic system has a predetermined number of solar cells. These solar cells are commercially available as solar panels 4*a*, wherein each solar panel 4*a* is rated for a certain voltage or electrical power. If a higher electrical power is desired several panels may be coupled together. The solar panels are typically arranged on the roof 5*a* of a building, but may be positioned at other locations, such as building walls or even remote from the building. It is contemplated that other alternative sources of (electrical) energy may be used as well, such as wind-powered generators that generate electrical energy when wind turns its rotor.

The number of required solar panels is chosen as a function of the requirements the building operator or architect define for the elevator installation 2, such as a maximum number of trips per hour, number of stops/floors, and residential or commercial building, which have different use patterns. The electrical energy generated by the solar panels is fed to and stored in a battery system (battery system 26 in FIG. 2) of between, e.g., about 24 V and 48 V, preferably 24 V or 48 V. A battery system is one example of an electrical energy storage device. The skilled person will appreciate that other voltages are possible as well. The battery system may include one or more individual batteries coupled in series so that the total voltage of the battery system is the sum of the voltages of the individual batteries. The energy management system 1 is coupled to the battery system, determines the available electrical energy, calculates the required energy for the next trip and determines if the battery system can provide the required energy for the next trip. In case the energy of the battery system is too low, a message "Solar recharging" is shown or the normal mode, i.e., power from the power grid 6, is restored.

Further, the number of solar panels 4*a* depends also on the geographical location of the building 5. It is contemplated that for each geographical location meteorological data is available or determinable that provides, e.g., the average number of sunny days per month and year type, and the sun's intensity on a month by month basis. The geographical location determines in combination with the meteorological data the angle and orientation at which the solar panels 4*a* are to be positioned on the roof 5*a*. The angle and orientation of the solar panels 4*a* may track the sun's position during the day and year. For most installations, however, it will likely suffice and be more economical to position the solar panels 4*a* at a fixed angle and orientation and to add one or more additional solar panels 4*a* to ensure the solar panels 4*a* provide sufficient energy over a year.

Figure 2:
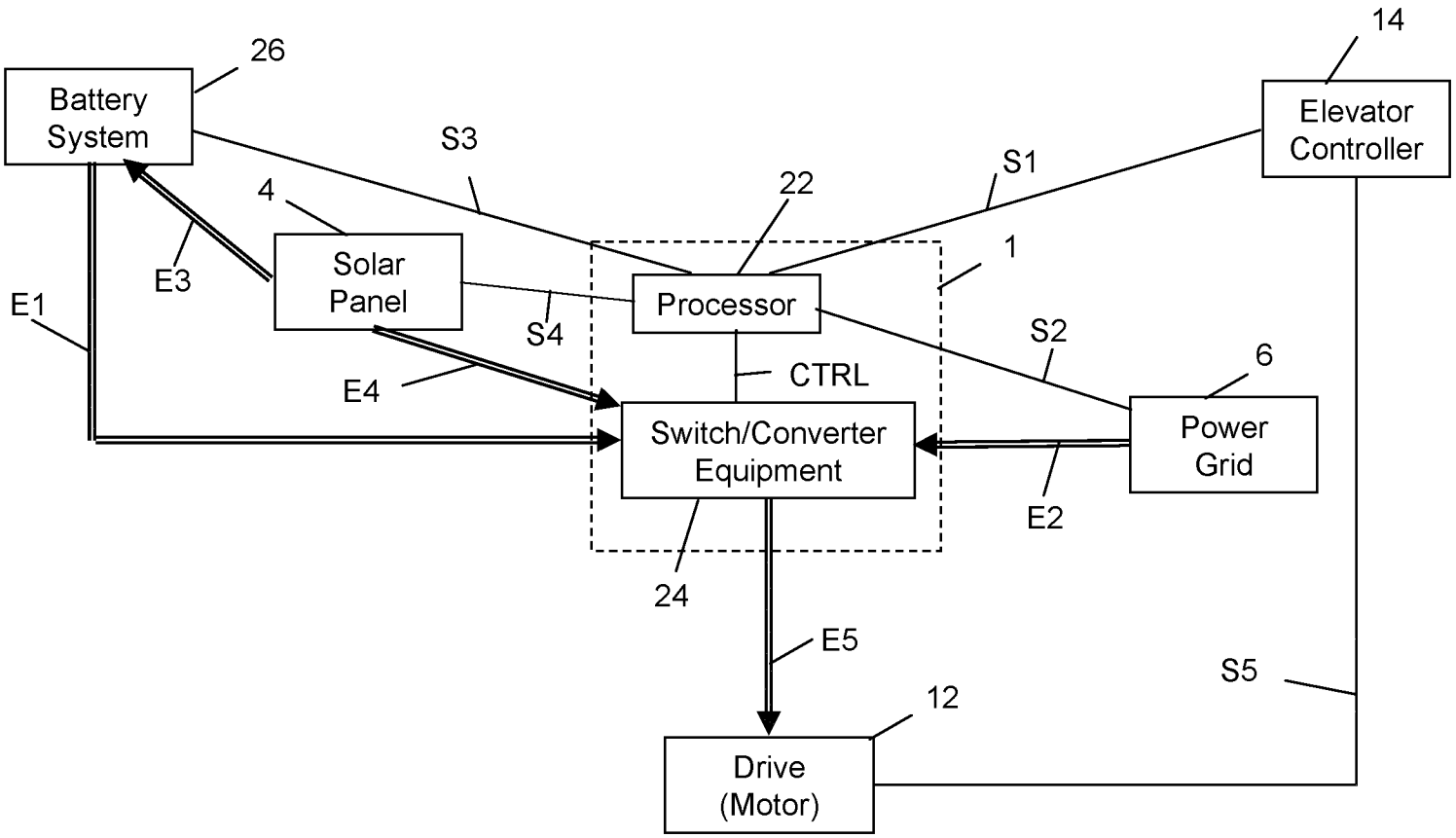
FIG. 2 schematically illustrates interactions of the energy management system with peripheral entities with respect to status and energy flow.

FIG. 2 schematically illustrates interactions of the energy management system 1 with peripheral entities. The peripheral entities include the power grid 6, the drive motor 12, the source of alternative energy 4, the elevator controller 14 and a battery 26 (or battery system). The interactions schematically shown in FIG. 2 include various data exchanges with respect to status information S1-S5 relating to these entities, and the routing of the energy via energy paths E1-E5.

The energy management system 1 includes a processor 22 and a switch/converter equipment 24 (also referred to as switch module). The processor 22 is coupled to the switch/converter equipment 24 by means of a signal line CTRL to control the switch/converter equipment 24. The processor 22 obtains status information S1 from the elevator controller 14, status information S2 from the power grid 6, status information S3 from the battery 26, and status information S4 from the source of alternative energy 4. As indicated in FIG. 2, the elevator controller 14 interacts with the drive 12 to obtain status information S5 from the drive 12. The switch/converter equipment 24 is coupled to the battery 26 via an energy path E1, to the power grid 6 via an energy path E2, to the source of alternative energy 4 via an energy path E4, and to the drive 12 via an energy path E5. An additional energy path E3 connects the source of alternative energy 4 to the battery 26.

Referring to FIG. 1 and FIG. 2, the following functions F1-F6 are defined in and implemented by the energy management system 1. In function F1 ("standby"), the energy management system 1 determines that the elevator installation 2 is in a standby mode, i.e., the car 8 is not moving and waiting for a passenger to request a trip, e.g., during low traffic periods or at nighttime. That information is provided via status line S1 from the elevator controller 14 as the stand-by mode is a well-defined mode in an elevator installation. During the standby mode the energy consumption is at a minimum because energy is only used for basic functions, such as powering electronic circuitry or illuminating landing operating panels, but not for powering the drive 12.

Further, the energy management system 1 obtains additional status information via status lines S3 and/or S4 indicative of energy available from the battery system 26 and/or the source of alternative energy 4/solar panel 4*a*. If such energy is available, the energy management system 1 causes in function F1 the elevator installation 2 to obtain the required energy in the standby mode from the battery system 26 via energy path E1 or directly from the source of alternative energy 4 via energy path E4. During daytime, for example, the source of alternative energy 4 completely supplies the elevator installation 2 in standby mode with energy. In addition, the source of alternative energy 4 charges—via energy path E3—the battery 26 in case not all generated energy is required for operating the elevator installation 2.

During nighttime, or during periods of no or low sunshine, the battery system 26 supplies the elevator installation 2 with energy via energy paths E1 and E5. As discussed, the source of alternative energy 4 charges the battery system 26 via the solar panels 4*a* during daytime. With the battery system 26 supplying the energy, no power from the power grid 6 is used. With 0 W consumption of energy from the power grid 6, the elevator installation 2 achieves a Class A, or higher A+++, energy consumption rating in standby mode. In the conventional Class A-G energy consumption rating system (see, e.g., EU Directive 2010/30/EU) used for a variety of energy consuming apparatuses, a Class A, or A+++, energy consumption rating is the highest possible rating. For example, if an energy consumption of about 50 W achieves a Class A rating, a 0 W energy consumption in standby would achieve a Class A+++ rating.

The energy management system 1 selects the function F2 ("backup/emergency power") to operate the elevator installation 2 in an emergency situation. For example, in case of a power failure of the power grid 6, the status information S2 of the power grid 6 changes to indicate such a power failure. The system's processor 22 detects that change, interprets it as a power failure and activates the switch/converter equipment 24 to change the energy path from energy path E2 to energy paths E1 or E4 to provide the drive motor 12 with energy via energy path E5 to keep the elevator installation 2 running.

In case of a power failure, the elevator installation 2 is automatically switched to "solar mode", which still allows using the elevator installation 2. To further improve the availability of the elevator installation 2 (e.g., for a longer period of time), its performance may be selectively reduced, for example, by switching off (floor) indicators, reducing light in the car 8, reducing a nominal speed at which the car 8 travels within the shaft, reducing the elevator installation's maximum payload, reducing the number of trips per hour, and/or, if the elevator installation 2 includes a group of elevators, operating only one elevator of the group, or operating for each trip only the elevator that provides for an optimized energy consumption of the group. The function F2 may be in particular applicable in countries that have frequent power interruptions.

The reduced availability or performance is likely noticeable by passengers. To inform passengers about the reason for the reduced availability or performance, an optional audio or video message, display or indicator may be provided inside the car 8 or at each landing indicating, e.g., "Running On Solar Energy", or "Battery Recharging", or similar, if the accumulated energy is low. More details regarding communicating information are described below with reference to FIG. 8.

The energy management system 1 selects the function F3 ("temporary solar mode") to operate the elevator installation 2 in (temporary) solar mode even though energy from the power grid 6 would be available. In that solar mode, the elevator installation 2 is exclusively powered by solar energy. The solar mode is selected with the objectives to conserve electrical energy, e.g., when traffic is low, or to reduce the operational costs, e.g., during times when electricity is more expensive, or a combination of these objectives.

The solar mode can be selected manually, e.g., by the building operator, or automatically when traffic is low or during the times electricity is more expensive. In one embodiment, the mode selection occurs at the elevator controller 14. Accordingly, the energy management system 1 detects any mode selection via the status information S1 and changes the energy path from E2 to E1 or E4 depending on the status information S3 and S4.

When the elevator installation 2 operates in the solar mode, the elevator controller 14 may be configured to modify the travel speed and/or acceleration of the elevator's car 8. For example, the travel speed may be adapted to the load in the car 8 to optimize the energy consumption. Further, the maximum allowable load may be reduced when the available energy is low; the load reduction may be referred to as "solar over load" and indicated as such to passengers, as described with reference to FIG. 8. This mode can be combined with energy recuperation when running in generator mode, see FIGS. 5 and 6.

The energy management system 1 may be implemented in an elevator installation 2 that is not connected to the power grid 6. In that case, the energy management system 1 selects function F4 ("permanent solar mode") and operates the elevator installation 2 exclusively with solar energy as the main energy source. The principal operation regarding evaluating the status information S1, S3 and S4 and the selection of the corresponding energy paths E1, E3 and E4 is as described with reference to the functions F1-F3.

The energy management system 1 may further be implemented in an elevator installation 2 that feeds energy generated by the solar panels back to the power grid 6. Accordingly, the energy management system 1 selects function F5 ("solar energy back to grid") if it determines that the elevator installation's energy consumption is lower than the energy currently provided by the solar panels. The solar panels, hence, generate a surplus of energy that may be fed back to the power grid. This situation may exist, e.g., when the elevator installation 2 is not used (standby) or traffic is low, as indicated via the status information S1.

The function F5 is particularly interesting in combination with a regenerative drive having a power factor (PF) of 1 (such a drive is referred to as PF1 power drive), as it allows to make the most of the PF1 power. The power of the PF1 drive is dimensioned for peak regenerative power of the elevator installation 2, and is usually used at this power only a few minutes per day. The exploitation of this PF1 power allows the user to afford a solar energy production at very low cost.

In one embodiment, the energy management system 1 may operate the elevator installation 2 in accordance with a function F6 ("grid power"). This function F6 may be a default mode, e.g., when the source of alternative energy 4 is not available or not desired. The source of alternative energy 4 may not be available, e.g., during repair, replacement or service. In one embodiment, the status information S1, S3 and S4 indicate such unavailability. In another embodiment, the function F6 may be manually set at the energy management system 1 to overwrite or ignore any status information S1, S3 and S4.

Figure 3:
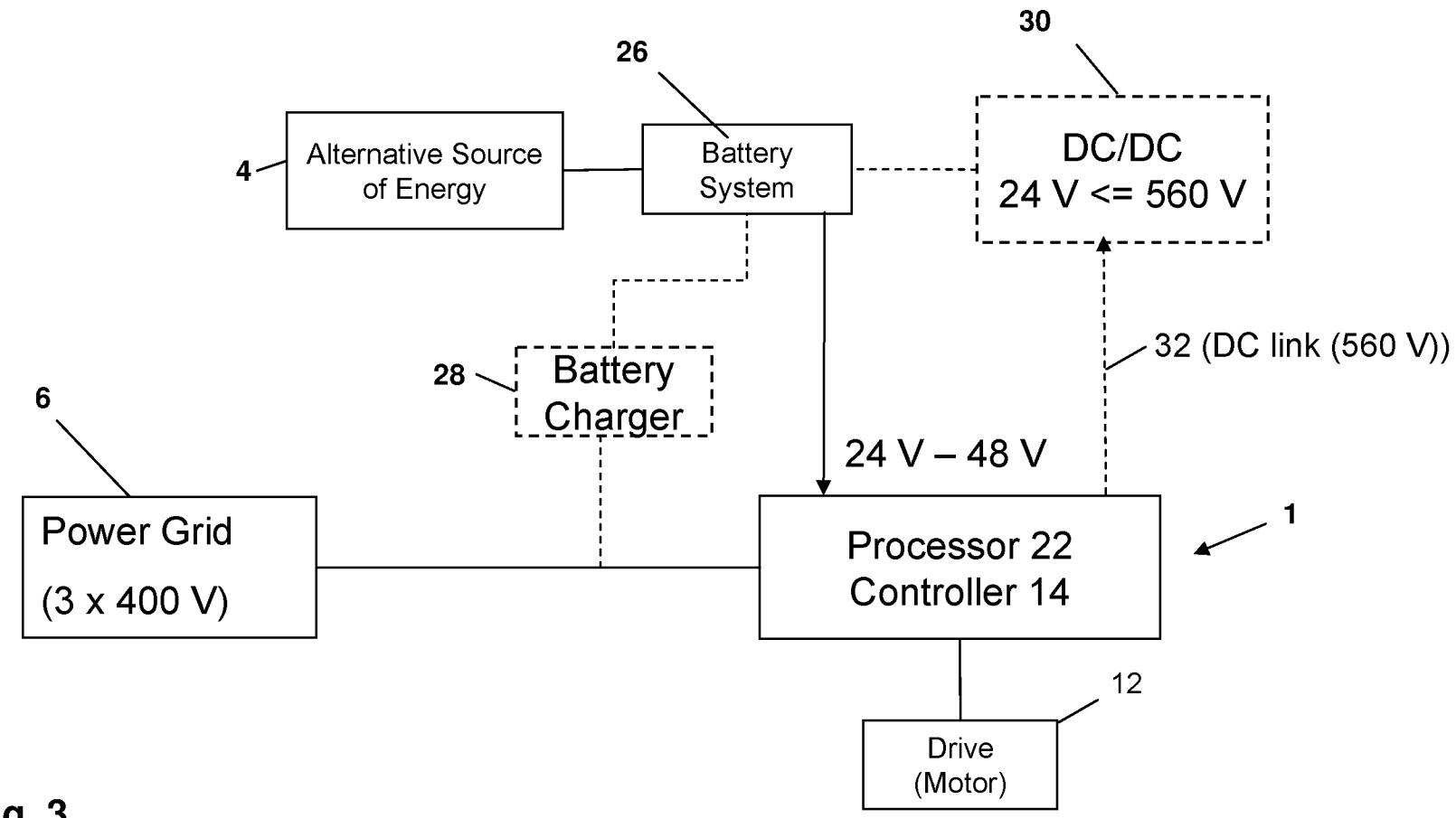
FIG. 3 is a schematic overview of a system that uses solar energy during standby operation.

FIG. 3 shows a schematic overview of an exemplary system that uses—according to function F1—solar energy during standby operation of the elevator installation 2. In FIG. 3, the processor 22 and the controller 14 are shown as being part of the energy management system 1 coupled to the drive motor 12. It is contemplated, however, that it is not relevant where the functionalities "processor" or "controller" are physically implemented. The energy management system 1 is connected to the power grid 6, and the battery system 26, which is further connected to the source of alternative energy 4. The power grid 6 is a 3-phase system providing 3×400 V. The battery system 26 provides a voltage of between about 24 V and about 48 V. In one embodiment, the battery system 26 provides a voltage of about 24 V. In another embodiment, the battery system 26 provides a voltage of about 48 V.

As discussed above with respect to the function F1, if the energy management system 1 determines via the controller 14 that the elevator installation 2 is in the standby mode, the energy management system 1 causes via the processor 22 the elevator installation 2 to obtain the required energy from the battery system 26 via the energy path E1, as shown in FIG. 3, or directly from the source of alternative energy 4 via the energy path E4.

In case the source of alternative energy 4 is not sufficient to charge the battery system 26 so as to provide sufficient power to the elevator installation 2, e.g., during periods of limited sunshine duration or intensity (e.g., in winter) an optional battery charger 28 may be provided. The battery charger 28 is coupled between the power grid 6 and the battery system 26. In FIG. 3, the fact that the battery system 26 is optional is indicated through dashed lines. The power consumption of the battery charger 28 may be limited to maximum 50 W to maintain the Class A energy rating of the elevator installation 2 during standby.

Another optional feature is a (uni-directional) DC/DC converter 30 (also shown through dashed lines in FIG. 3) coupled via a link 32 for DC voltage (hereinafter referred to as DC link) between the energy management system 1 and the battery system 26. That feature may be applied when the elevator installation 2, i.e., its drive motor 12, performs a regenerative trip. In that case, the DC link 32 feeds a voltage of about 560 V to the DC/DC converter 30. The DC/DC converter 30 uses that input voltage of about 560 V to output a voltage of, e.g., about 24 V to be fed to the battery system 26.

The various configurations of DC/DC converters are generally known in the art of electronic circuit design. They may be configured as uni-directional converters or as bi-directional converters, wherein a bi-directional converter may be used as a uni-directional converter as well. One example of a bi-directional DC/DC converter is a split-pi converter which allows energy flow from a first port (e.g., input) to a second port (e.g., output) and in the opposite direction, i.e., from the second port to the first port. This converter uses controlled switches to cyclically store energy in coils, and capacitors to smoothen the DC voltage. Another embodiment of a DC/DC converter is described below with reference to FIG. 7.

Figure 4:
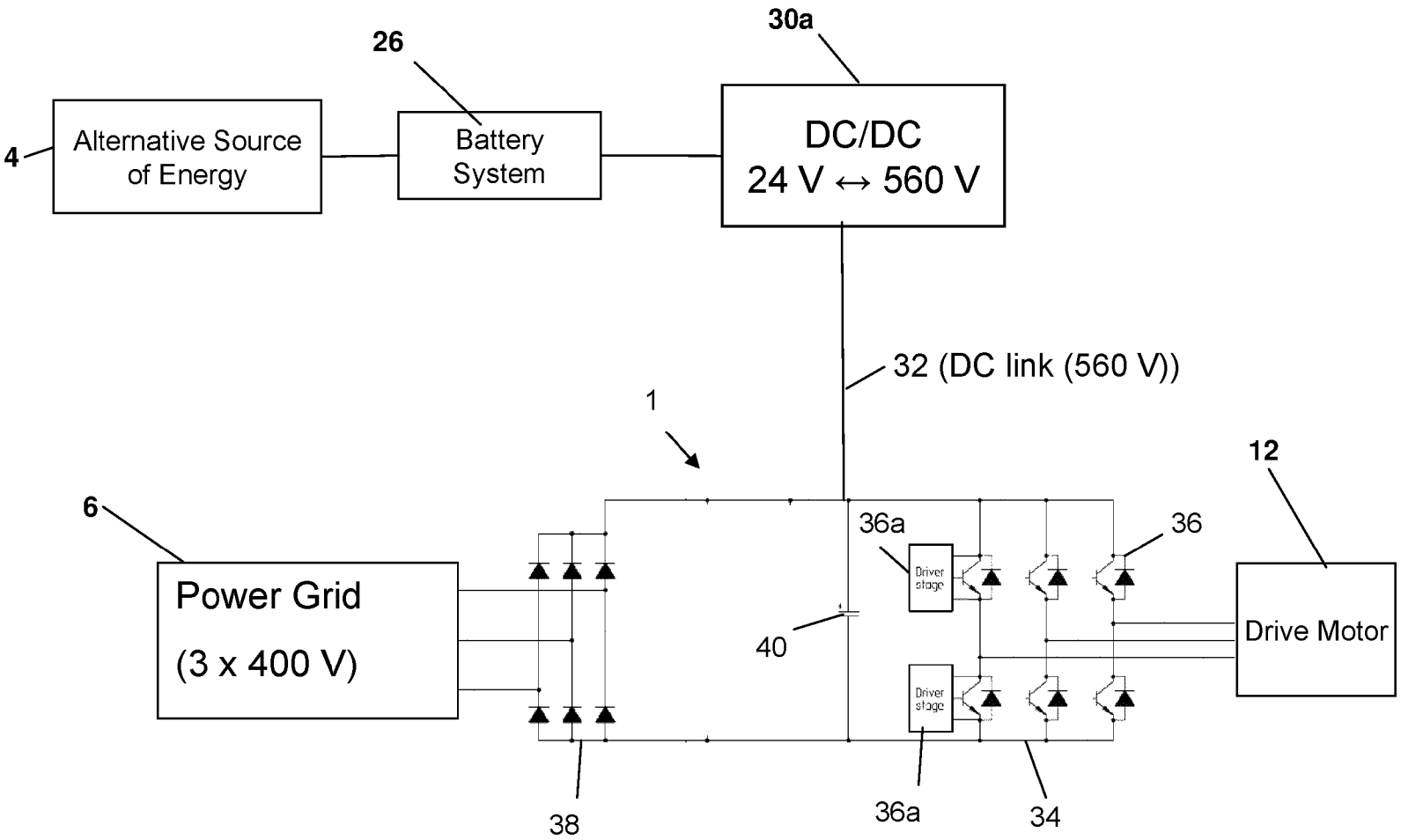
FIG. 4 is a schematic overview of a system—based on a power grid—that uses solar energy and allows feedback of a regenerative energy to a battery system.

FIG. 4 is a schematic overview of an exemplary system that can use energy from the power grid 6 or the source of alternative energy 4, and allows feedback of regenerative energy to the battery system 26. An electronic circuitry 34, 38, which is herein viewed as part of the energy management system 1, is coupled to the power grid 6, the drive motor 12 and a bi-directional DC/DC converter 30*a* via DC link 32. The DC/DC converter 30*a* is further coupled to the battery system 26, which is coupled to the source of alternative energy 4. The processor 22 or controller 14 are not shown in FIG. 4, however, it is contemplated that these components are still present in the elevator installation 2 and perform their respective functions as described above.

As indicated in FIG. 4, in a direction from the battery system 26 to the energy management system 1, the DC/DC converter 30*a* converts the (24 V) voltage provided by the battery system 26 to a voltage of about 560 V input to the energy management system 1. In opposite direction, the DC/DC converter 30*a* converts the (560 V) voltage provided by the energy management system 1 to a voltage of about 24 V to be fed to the battery system 26.

The drive motor 12 is one component of a variable frequency drive system that includes a driver/controller circuitry (34, 38). The driver/controller circuitry (34, 38) includes solid-state electronic power conversion devices, such as insulated gate bipolar transistors (IGBT) with anti-parallel diodes, wherein the transistors act as switches. For illustrative purposes, the driver/controller circuitry (34, 38) is in FIG. 4 part of the energy management system 1; in an alternative illustration, the driver/controller circuitry (34, 38) may be part of the drive motor 12. The drive motor 12 is a three-phase induction motor and coupled to the driver/controller circuitry, which outputs a drive signal for the drive motor 12. As known in the art of elevator drives, the rotational speed of the drive motor 12 depends on the frequency of the drive signal; a change in the drive signal frequency leads to a change of the motor's rotational speed.

The three-phase (3×400 V) power grid 6 is coupled to a three-phase rectifier circuitry 38 of the driver/controller circuitry. The rectifier circuitry 38 is a full-wave diode bridge that outputs for each phase a pulsating DC signal of a predetermined voltage. These DC signals charge a capacitor 40 to a DC voltage of about 560 V. The DC voltage to which the capacitor 40 is charged is usually referred to as "DC link". An inverter switching circuitry 34 of the driver/controller circuitry is coupled to the drive motor 12 and converts the DC signals to (three-phase) quasi-sinusoidal AC signals that drive the drive motor 12.

In the embodiment of FIG. 4, the inverter switching circuitry 34 includes an arrangement of three branches, one for each phase, that are connected in parallel to the capacitor 40. Each branch has a serial arrangement of two switches 26, e.g., insulated gate bipolar transistors hereinafter referred to as IGBTs 36, each having an anti-parallel diode. Between the two serial IGBTs 36 of a branch, a connection to the drive motor 12 exists. Each switch/IGBT 36 is controlled by a driver stage 36*a* (only two are shown in FIG. 4) that controls the switching of the IGBT 36 at a predetermined frequency to generate the 3-phase sinusoidal signal for driving the drive motor 12.

Figure 5:
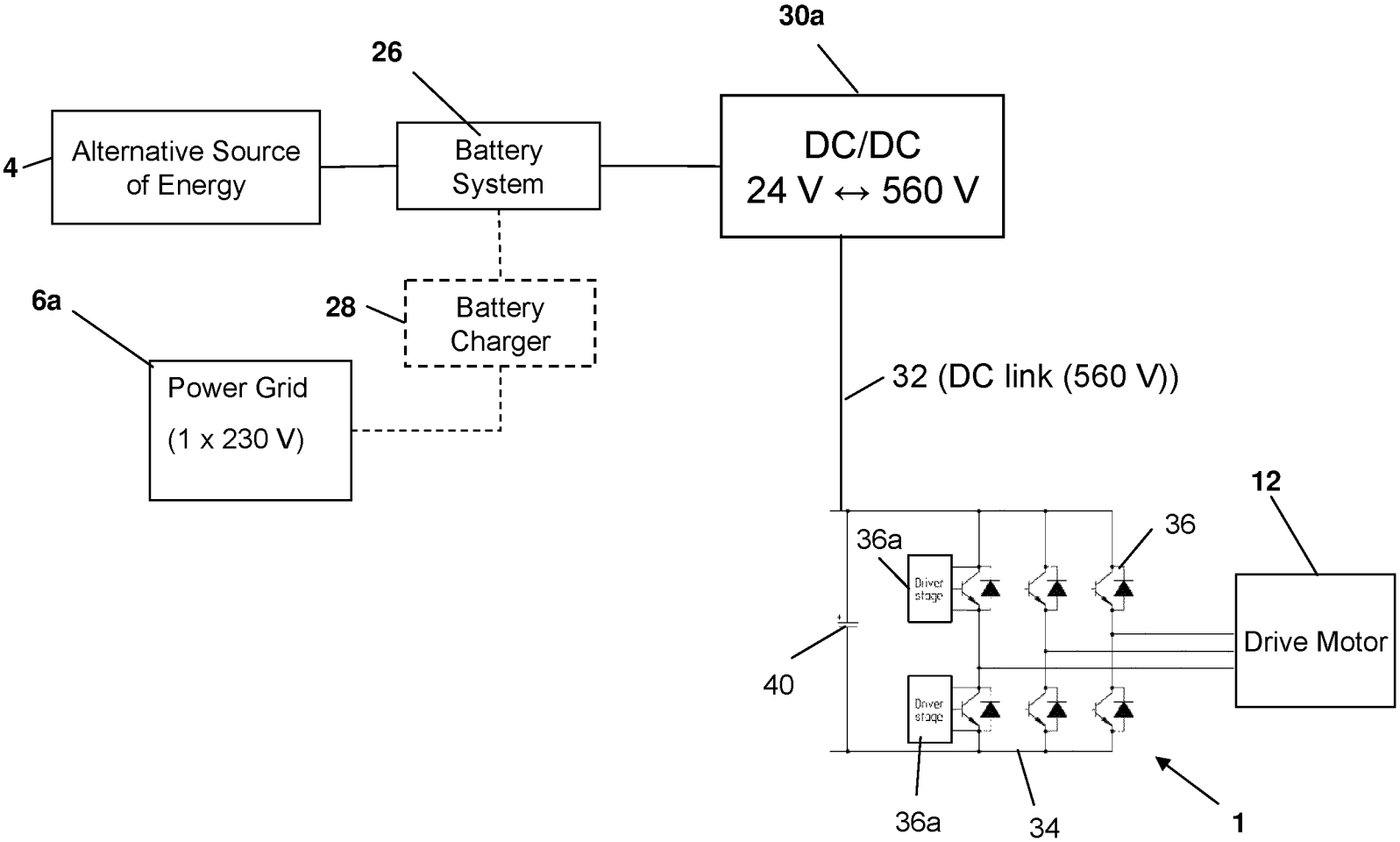
FIG. 5 is a schematic overview of the system—without a power grid—that uses solar energy and allows feedback of a regenerative energy to a battery system.

FIG. 5 is a schematic overview of an exemplary system that is configured to use mainly energy from the source of alternative energy 4 to operate the elevator installation 2, and that allows feedback of regenerative energy to the battery system 26. The system includes the source of alternative energy 4, the battery system 26 and the bidirectional DC/DC converter 30*a* which are connected and operate as described with reference to FIG. 4. The system of FIG. 5 differs from the system shown in FIG. 4 in that the energy management system 1 is not directly coupled to a power grid. Accordingly, the energy management system 1 includes the inverter switching circuitry 34 and the capacitor 40, but not the rectifier circuitry 38 shown in FIG. 4.

As there may be times during which the energy stored in the battery system 26 will not suffice to operate the elevator installation 2, the battery system 26 is coupled to an optional battery charger 28. The battery charger 28 is coupled to a one-phase 230 V power grid 6*a* and the battery system 26. The battery charger 28 operates as described with respect to FIG. 3. It is contemplated that the 230 voltage is exemplary and that the public power grid (power network) of a particular country may provide a different voltage.

Advantageously, the system shown in FIG. 5 does not require a three-phase 400 V power grid. Instead, a one-phase 230 V power grid suffices to power the battery charger 28. In industrialized countries, residential and commercial buildings are typically connected to the public power grid that provides such a 230 V system, whereas access to a three-phase 400 V system is not always commonly provided, not possible at all or only at additional expense. The system of FIG. 5, however, allows operation of the elevator installation 2 even via a one-phase 230 V power grid, namely by means of the battery charger 28 that charges the battery system 26, which then powers the elevator installation 2. Even if the source of alternative energy 4 is not available, the elevator installation 2 can be powered by means of the battery system 26 and the battery charger 28, again via the one-phase 230 V power grid 6*a*.

Furthermore, it is an advantage that the system takes the energy during times of peak consumption by the drive motor 12 from the battery system 26, and not from the power grid. This is another reason why a one-phase 230 V power grid suffices. The operational costs are thereby further reduced as no access to a three-phase 400 V power grid needs to be provided.

Figure 6:
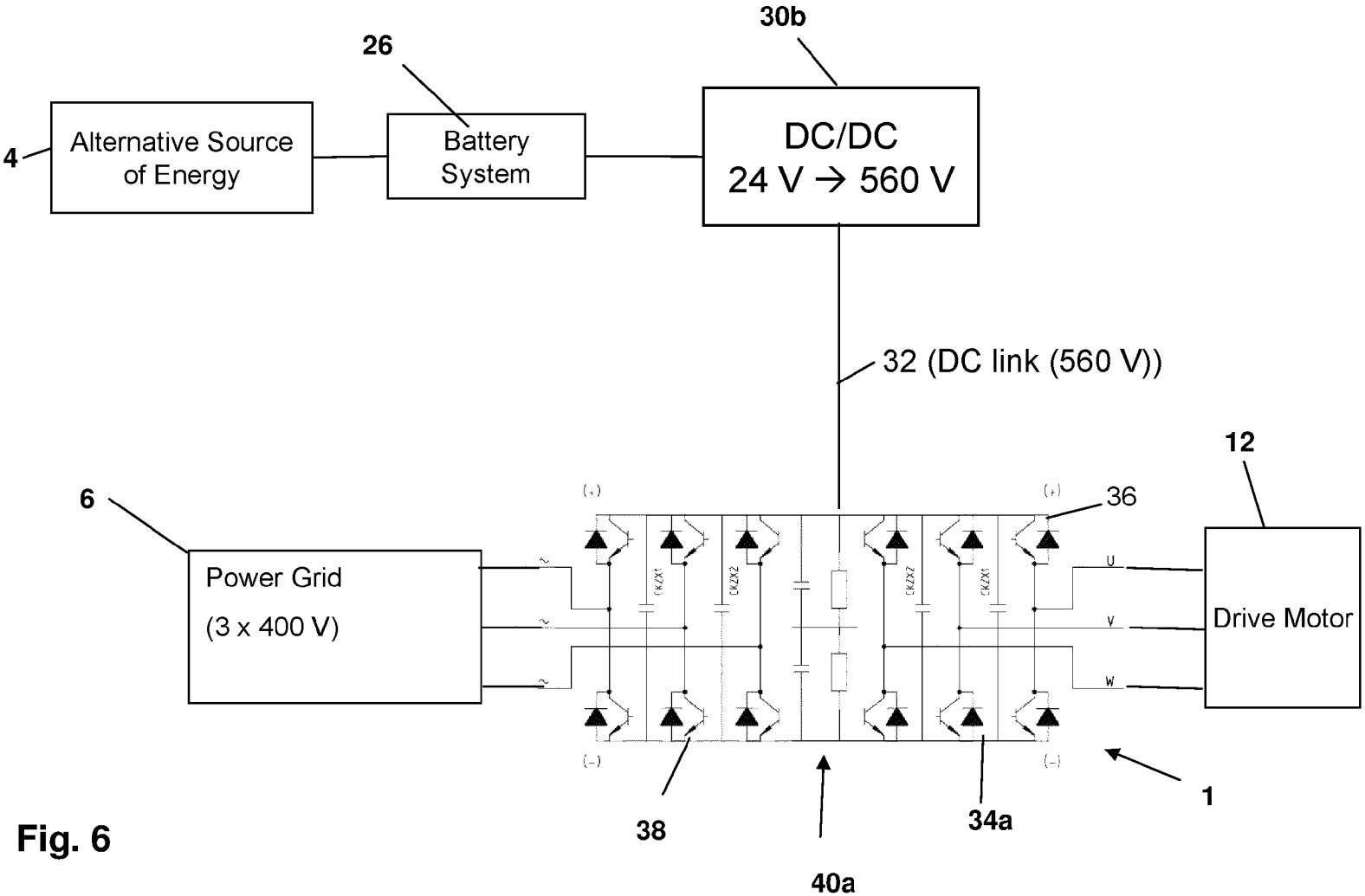
FIG. 6 is a schematic overview of a system that feeds energy from a source of alternative energy to the power grid.

FIG. 6 is a schematic overview of an exemplary system that is configured to use energy from the source of alternative energy 4 to operate the elevator installation 2, and that allows feedback of energy generated by the source of alternative energy 4. The system includes the source of alternative energy 4, the battery system 26 and a unidirectional DC/DC converter 30*b*. As indicated in FIG. 6, the DC/DC converter 30*b* converts the (24 V) voltage provided by the battery system 26 to a voltage of about 560 V input to the energy management system 1 via DC link 32. The energy management system 1 is coupled to the power grid 6 and the drive motor 12.

The energy management system 1 has an inverter switching circuitry 38*a*, which is coupled to the power grid 6, and an inverter switching circuitry 34*a*, which is coupled to the drive motor 12. A DC link circuitry 40*a* is coupled between the inverter switching circuitries 38*a* and 34*a*. In the illustrated embodiment the DC link circuitry 40 includes a parallel arrangement of two serial capacitors and two serial resistors. The operation of these circuitries is as follows:

If the energy management system 1 operates the elevator installation 2 in solar mode (e.g., functions F2, F3 and F4), the DC/DC converter 30*b* outputs a DC voltage of about 560 V to the DC link 32, and the inverter switching circuitry 34*a* converts that DC voltage to a three-phase drive signal to drive to drive motor 12.

If the energy management system 1 operates the elevator installation 2 in solar-energy back to grid to mode (function F5), the DC/DC converter 30*b* outputs a DC voltage of about 560 V to the DC link 32, and the inverter switching circuitry 38*a* converts that DC voltage to a three-phase voltage (3×400 V) that is fed back to the power grid 6.

If the energy management system 1 operates the elevator installation 2 in grid power mode (function F6), the inverter switching circuitry 38*a* acts as a rectifier circuitry (compare rectifier circuitry 38 in FIG. 4) that outputs a DC voltage which is then converted back to an AC voltage by the inverter switching circuitry 34, as described with respect to FIG. 4.

The electronic circuitries 34*a*, 38, 40*a* are part of an elevator installation that uses regenerative energy generated by the drive motor 12 and feeds that energy back to the power grid 6. Advantageously, such an elevator installation may be modified to not only feed regenerative energy back to the power grid 6 but also energy generated by the source of alternative energy 4. For example, a building owner may want to use solar energy to provide electric energy for the building (e.g., for heating/cooling or elevator purposes). If a solar system is installed, an added benefit at minimum additional cost is the capability of feeding energy generated by the solar system back to the power grid 6 if not all generated solar energy is used in the building.

Figure 7:
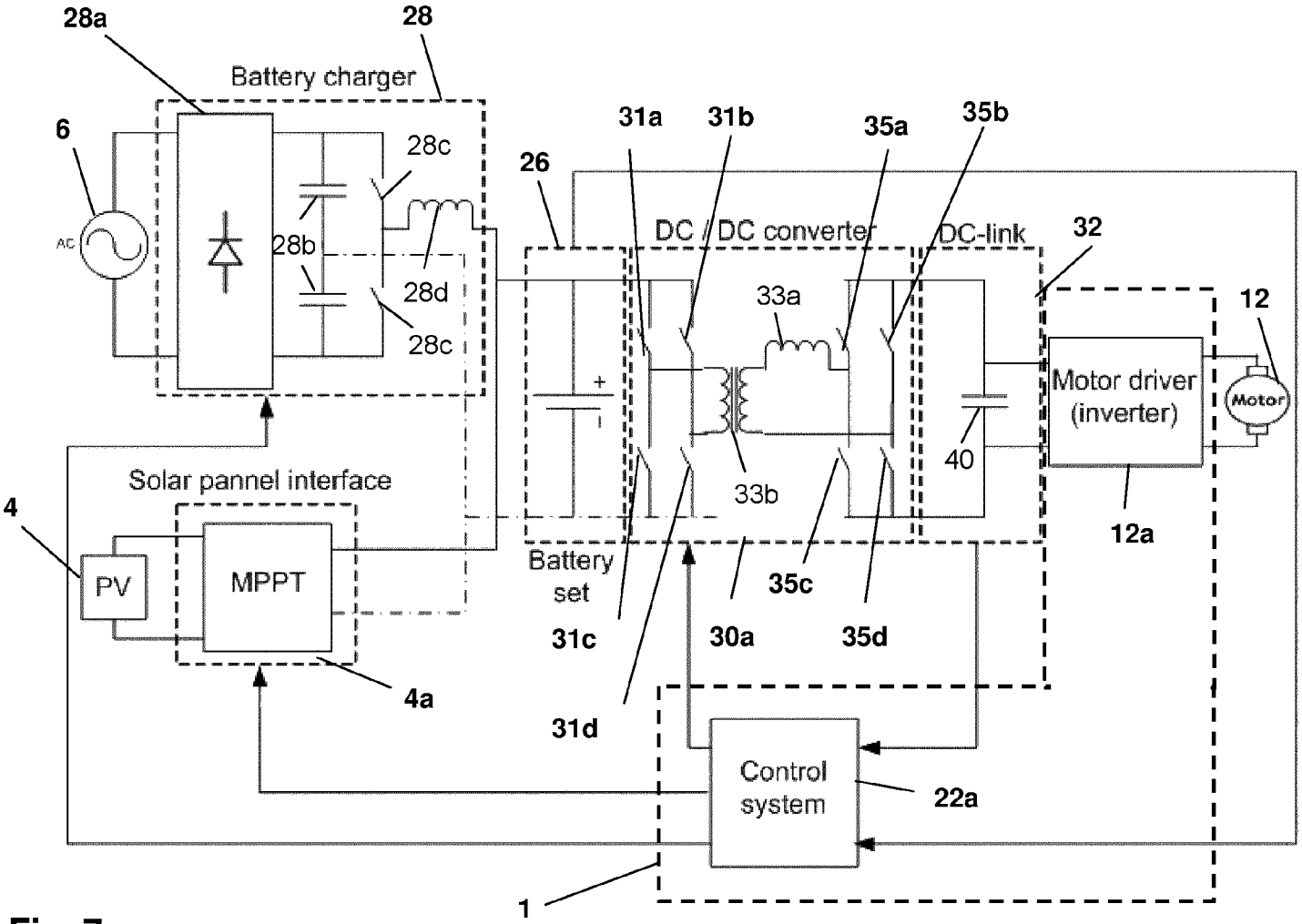
FIG. 7 schematically illustrates one embodiment of a DC/DC converter.

FIG. 7 is a more detailed schematic overview of the exemplary system of FIG. 5, i.e., a system that is configured to use mainly energy from the source of alternative energy 4 to operate the elevator installation 2, and that allows feedback of regenerative energy to the battery system 26. The system includes the source of alternative energy 4 (in FIG. 7 shown as PV for photovoltaic system (solar panel)), the battery system 26, the battery charger 28, the bidirectional DC/DC converter 30*a*, the DC link 32 and the energy management system 1. A solar panel interface 4*a* (in FIG. 7 shown as MPPT for maximum power point tracker) is coupled between the source of alternative energy 4 and the battery system 26. Use of the solar panel interface 4*a* is preferable; it may be used to optimize the power generation efficiency of the solar panel. The solar panel interface 4*a* is commercially available; it is an electronic circuit having a DC/DC converter that optimizes the match between the source of alternative energy 4 and the battery system 26 by converting the optimum DC voltage applied to the source of alternative energy 4 to a lower DC voltage needed to charge the battery system 26.

The solar panel interface 4*a* is coupled to the control system 22*a* to receive a signal from the control system 22*a* indicative of whether or not maximum energy from the source of alternative energy 4 (solar panel) is to be taken, or a reduced amount in case the battery system 26 is already fully charged. In one embodiment, the solar panel interface 4*a* is integrated in the energy management system 1 to further obtain a higher degree of integration of all functions relating to managing the energy; this results, e.g., in an optimization regarding space requirements and cost.

The energy management system 1 controls the battery charger 28, the solar panel interface 4*a* (if present), the DC/DC converter 30*a*, and receives input from the DC link 32 and the battery system 26. For ease of illustration, the control and drive functionalities of the energy management system 1 are illustrated as blocks labeled as control system 22*a* and motor driver (inverter) 12*a*. The control system 22*a* corresponds to the function of the processor 22 shown in FIG. 3, and the motor drive (inverter) 12*a* corresponds to the function of the inverter 34, 34*a* shown in FIGS. 5 and 6.

The DC/DC converter 30*a* is coupled between the battery system 26 and the DC link 32, and receives control signals from the control system 22*a*. These control signals control (MOSFET) switches 31*a*-31*d*, 35*a*-35*d* of the DC/DC converter 30*a* according to a predetermined sequence to enable the voltage conversion. Further, the DC/DC converter 30*a* includes a transformer 33*b* and an inductance 33*a*, wherein a first group of the switches 31*a*-31*d* is on one side of the transformer 33*b* and a second group of the switches 35*a*-35*d* is on the other side of the transformer 33*b*. In each group, two subgroups of serially connected switches are connected in parallel to each other and to terminal ports.

The DC/DC converter 30*a* is configured for about 6 kW in case of a residential elevator installation, or about 12 kW, or more, for commercial or mid-rise elevator installation applications. Briefly, as viewed from the battery system 26, the switches 31*a*-31*d* convert the (low) DC battery voltage to an AC voltage of a predetermined frequency (e.g., about 100 kHz). The transformer 33*b* transforms the AC voltage to a higher AC voltage of the same predetermined frequency. The MOSFET switches used in the DC/DC converter 30*a* allow faster switching than, e g IGBT switches, so that the size of the transformer 33*b* is smaller than at lower frequencies. The switches 35*a*-35*d* convert the AC voltage to a DC voltage (e.g., 560 V) that charges the capacitor 40 of the DC link 32. Further, the transformer 33*b* completely isolates the DC voltages one either side of the transformer 33*b* from each other.

The control system 22*a* measures the DC voltages on both sides of the DC/DC converter 30*a* and controls the MOSFET switches accordingly to transfer the correct quantity of energy. Therefore, the voltage of the DC link 32 is maintained at nominal value.

The battery charger 28 includes a rectifier 28*a* that converts the AC voltage from the power grid 6 to a DC voltage that charges two serially connected capacitors 28*b*. Two serially connected switches 28*c* (semiconductor switches) are connected in parallel to the serially connected capacitors

28*b*. One terminal of an inductor 28*d* is connected to a line connecting the switches 28*c*, and the other terminal is connected to the battery system 28 and the solar panel interface 4*a*. A control line 4*a* is connected to a line that connects the two capacitors 28*b*, and to the solar panel interface 4*a*.

Further, the battery charger 28 is designed to charge several individual batteries connected in series. During that process, the battery charger 28 controls a balancing of the battery charging because, at a given time, not all batteries may have the same charge status. In such a case, the battery charger 28 shuts the charge current from a battery that has a higher charge status than others.

In one embodiment, the battery system 26 is coupled to the elevator controller 14 so that the elevator controller 14 is powered by the battery system 26. In this embodiment, a connection to a 230 V power grid is no longer required.

Figure 8:
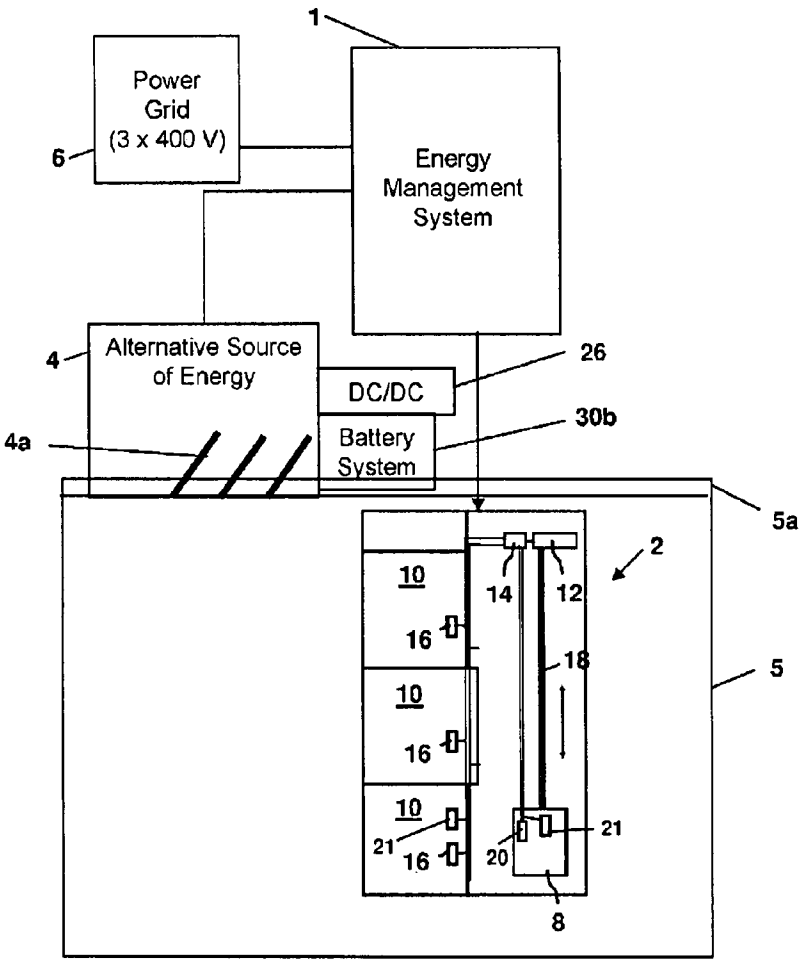
FIG. 8 schematically illustrates one embodiment of an elevator installation in a building, with a battery system and a DC/DC converter positioned on top of a building.

FIG. 8 schematically illustrates one embodiment of an elevator installation 2 in a building 5, wherein the battery system 26 and the DC/DC converter 30 (30*a*, 30*b*) are positioned on the roof 5*a* of the building 5. It is contemplated, however, that in another embodiment, only one of the battery system 26 and the DC/DC converter 30 (30*a*, 30*b*) may be positioned on the roof 5*a*. In one embodiment, the battery system 26 or the DC/DC converter 30 (30*a*, 30*b*), or both, are placed next to, e.g., below the solar panels. The solar panel then serves as a cover or protection to protect these components from weather or environmental conditions. If additional or better protection against such conditions is desired, a separate structure (cabinet or box) located next to the solar panel on the roof 5*a* may be provided to house the battery system 26 and/or the DC/DC converter 30 (30*a*, 30*b*).

It is contemplated that the concept of placing the battery system, or the DC/DC converter 30 (30*a*, 30*b*), or both, on the roof 5*a* is applicable to any systems that use solar panels to power elevator installations. Such systems may or may not use an energy management system as described herein.

Advantageously, the battery system 26 or the DC/DC converter 30 (30*a*, 30*b*), or both, do not need to be positioned inside the building 5, e.g., in the elevator shaft. No space inside the building 5 needs to be reserved for the battery system 26 or the DC/DC converter 30 (30*a*, 30*b*). This provides, e.g., more flexibility when designing the elevator installation 2 for a particular building 5 because the space requirements of the battery system 26 and/or the DC/DC converter 30 (30*a*, 30*b*) do not need to be considered. Depending on a particular configuration of the elevator installation 2 (e.g., energy requirement, number of stops/floors, residential or commercial building, etc.) the battery system 26 or the DC/DC converter 30 (30*a*, 30*b*) may be relatively big, but the roof 5*a* usually has sufficient space to place any size of battery system 26 and/or DC/DC converter 30 (30*a*, 30*b*) in proximity of the solar panels.

Furthermore, positioning the battery system 26 and/or the DC/DC converter 30 (30*a*, 30*b*) in proximity of the source of alternative energy 4 (solar panel) minimizes the length of the transmission path (i.e., the cable length) between the solar panel and the battery system 26, and between the battery system 26 and the DC/DC converter 30 (30*a*, 30*b*). Power loss is, therefore, reduced.

The elevator installation 2 may be configured to communicate information relating to a general or current operational mode, or parameters of the elevator installation 2 to a building operator or owner, elevator service and maintenance personnel, building tenants or visitors, or elevator users/passengers, or a combination of these groups. For example, some building operators or owners may wish to convey an environmental or "green" image by communicating that the elevator installation 2 is powered by solar energy, e.g., generally or only temporarily. The effect of the use of solar energy on the elevator user's $CO_2$ footprint reduction may be communicated as well.

Communicating the operational mode or parameters may occur, e.g., through illuminated on/off indicators, monitors or (video) displays. Referring to the FIGS. 1 and 8, the elevator installation 2 already has floor terminals 16 and car terminals 20. In addition to their conventional functions, these terminals 16, 20 may be configured to communicate the operational mode or parameters. In an alternative embodiment, dedicated indicators, monitors or displays separate from these terminals 16, 20 may be provided, e.g., on all or only selected floors (e.g., the lobby) and/or inside the cars 8. FIG. 8 shows an embodiment having display devices 21 separate from the terminals 16, 20, one being provided inside the car 8 and on one of the floors 10. It is contemplated, however, that the display devices 21 may be provided at other locations within the elevator installation 2 or the building 5 as well.

Monitors or (video) displays 42—either part of the terminals 16, 20 or as separate components such as the display devices 21—are advantageous because they provide more options for communicating information relating to the operational mode, e.g., graphs, multilevel menus, in combination with multimedia content, weather information, etc. Examples of such information are: remaining energy in the battery system 26, e.g., expressed in number of trips, actual percentage of power provided by the solar panel 4, actual power generated by the solar panel (e.g., level of irradiation), actual (regenerative) power generated by the drive motor 12, "solar over load" and/or reasoning why, e.g., the elevator speed is lower or the car light is dimmed.

Figure 9B:
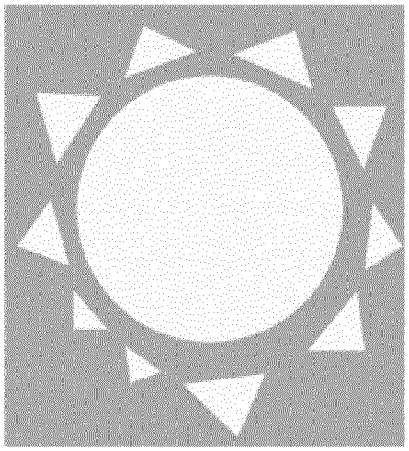
FIGS. 9*a*, 9*b*, 9*c* depict various examples of symbols and pictograms shown on a display device.
Figure 9C:
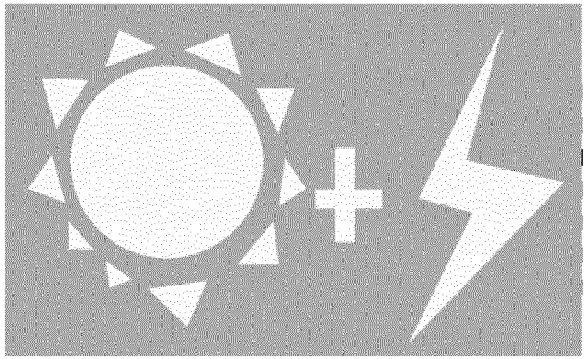
Figure 9A:
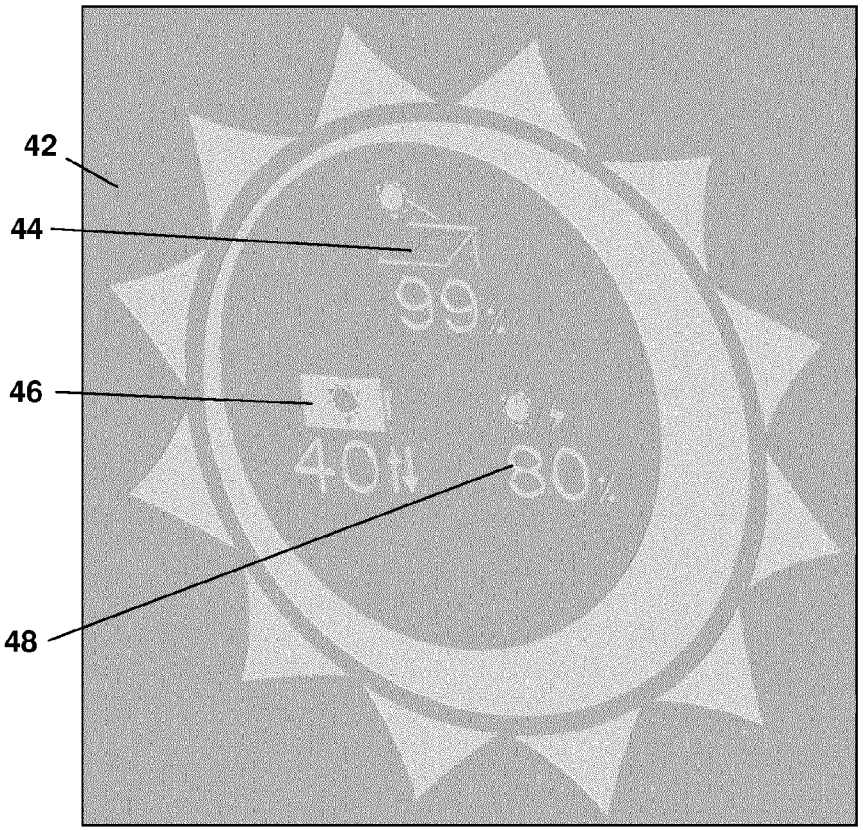

FIGS. 9*a*, 9*b* and 9*c* depict various examples of symbols and pictograms shown on the display 42. In FIG. 9*a*, with a stylized sun as background, three pictograms 44, 46 and 48 are shown, each representing a parameter of the elevator installation 2 or the source of alternative energy 4. Pictogram 44 represents a current illumination in percent of the solar panel, e.g., 99%. Pictogram 46 represents a number of trips, e.g., 40, that are possible with the energy stored in the battery system 26. Pictogram 48 represents a ratio of solar energy usage to grid power usage in percent, e.g., solar energy supplies 80% of the energy and the power grid 20%.

As described above, the energy management system 1 may operate the elevator installation in temporary or permanent solar mode (F3, F4). In these modes, a pictogram as shown in FIG. 9*b* may be displayed to indicate that the elevator installation 2 is running on solar energy only. The pictogram shown in FIG. 9*c* may be displayed to indicate that the elevator installation 2 is running in a hybrid mode.

It is contemplated that the more or less pictograms, or different ones, may be shown on the display 42. Further, in addition to or as an alternative to these pictograms, alphanumerical text may be displayed as well.

It is apparent that there has been disclosed an energy management system for an elevator installation that fully satisfies the objects, means, and advantages set forth herein before. For example, the energy management system integrates various operational modes and selectively executes these modes depending on predetermined parameters. The energy management system provides improved flexibility that allows operation and use of the elevator installation under a variety of different environmental and economic conditions. For example, this allows a provider of elevator installations to use the energy management system in every elevator installation of a certain segment (e.g., residential, mid-rise) regardless of a specific country or its climatic conditions. In a country with a high number of sunshine days (e.g., India) the energy management system may operate an elevator installation, e.g., in the permanent solar mode with or without access to a power grid and with or without feedback of generated energy (solar or regenerative). On the other hand, in northern European countries, the energy management system may operate an elevator installation with solar energy only during times of standby. It is contemplated that the energy management system is "intelligent", i.e., it is programmed to select an appropriate mode in view of the various status information described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An energy management system for an elevator installation coupled to a source of alternative energy, comprising:

a processor having a first input for coupling to an electrical energy storage device to obtain a parameter indicative of a charge status of the electrical energy storage device, a second input for coupling to the source of alternative energy to obtain a parameter indicative of power available from the source of alternative energy, a third input for coupling to an electrical power grid to obtain a parameter indicative of a status of the power grid, and a forth input for coupling to a controller of the elevator installation to obtain a parameter indicative of an operation of the elevator installation; and a switch module coupled to the processor to receive a control signal from the processor, the switch module having a first port for coupling to the electrical energy storage device, a second port for coupling to the source of alternative energy, a third port for coupling to the electrical power grid and a fourth port for coupling a drive motor of the elevator installation to one of the electrical energy storage device, the source of alternative energy and the electrical power grid, wherein the processor is configured to process at least one of the parameters to select one of a plurality of operational modes of the elevator installation, to generate the control signal as a function of the selected operational mode to cause an energy flow from one of the ports of the switch module to another port of the switch module, to detect via the parameter indicative of an operation of the elevator installation that the elevator installation is in a standby mode, and to control the switch module to supply energy from one of the first port and the second port of the switch module to the elevator controller.

2. The energy management system of claim 1, wherein the processor is further configured to detect via the parameter indicative of an operation of the elevator installation that a drive motor of the elevator installation is in a regenerative mode, and to control the switch module to allow energy flow from the forth port to one of the first port and the third port of the switch module.

3. The energy management system of claim 2, wherein the processor is further configured to detect via at least the parameter indicative of power available from the source of alternative energy that a surplus of alternative energy is available, and to control the switch module to allow energy flow from the second port to the third port of the switch module so that alternative energy is fed back to the power grid.

4. The energy management system of claim 1, wherein the processor is further configured to detect via at least the parameter indicative of power available from the source of alternative energy that a surplus of alternative energy is available, and to control the switch module to allow energy flow from the second port to the third port of the switch module so that alternative energy is fed back to the power grid.

5. A system comprising:

an elevator installation having a drive motor and an elevator controller;

a source of alternative energy coupled to an electrical energy storage device; and an energy management system comprising a processor and a switch module coupled to the processor to receive a control signal from the processor, wherein the processor has a first input for coupling to an electrical energy storage device to obtain a parameter indicative of a charge status of the electrical energy storage device, a second input for coupling to the source of alternative energy to obtain a parameter indicative of power available from the source of alternative energy, a third input for coupling to an electrical power grid to obtain a parameter indicative of a status of the power grid, and a forth input for coupling to a controller of the elevator installation to obtain a parameter indicative of an operation of the elevator installation, wherein the switch module has a first port for coupling to the electrical energy storage device, a second port for coupling to the source of alternative energy, a third port for coupling to the electrical power grid and a fourth port for coupling a drive motor of the elevator installation to one of the electrical energy storage device, the source of alternative energy and the electrical power grid, and wherein the processor is configured to process at least one of the parameters to select one of a plurality of operational modes of the elevator installation, to generate the control signal as a function of the selected operational mode to cause an energy flow from one of the ports of the switch module to another port of the switch module, to detect via the parameter indicative of an operation of the elevator installation that the elevator installation is in a standby mode, and to control the switch module to supply energy from one of the first port and the second port of the switch module to the elevator controller.

6. The system of claim 5, further comprising a voltage converter coupled between the energy management system and the electrical energy storage device, wherein the voltage converter is configured to convert a predetermined voltage provided via a DC link to a voltage adapted to a predetermined voltage of the electrical energy storage device, and/or to convert the predetermined voltage of the electrical energy storage device to the predetermined voltage of the DC link.

7. The system of claim 6, further comprising a charge device coupled to the electrical energy storage device and the power grid to charge the electrical energy storage device with energy from the power grid, wherein the power grid is a one-phase power grid or a three-phase power grid.

8. The system of claim 7, wherein the source of alternative energy, the voltage converter and the electrical energy storage device are positioned on a roof of a building.

9. The system of claim 8, wherein the voltage converter and the electrical energy storage device are positioned in proximity of the source of alternative energy.

10. The system of claim 5, further comprising a charge device coupled to the electrical energy storage device and the power grid to charge the electrical energy storage device with energy from the power grid, wherein the power grid is a one-phase power grid or a three-phase power grid.

11. A method of managing energy for an elevator installation, comprising:

processing at least one parameter of a group comprising a parameter indicative of a charge status of an electrical energy storage device, a parameter indicative of power available from a source of alternative energy, a parameter indicative of a status of a power grid, and a parameter indicative of an operation of the elevator installation, wherein the processing is performed by a processor having a first input for coupling to the electrical energy storage device, a second input for coupling to the source of alternative energy, a third input for coupling to the electrical power grid, and a forth input for coupling to a controller of the elevator installation to obtain the parameter indicative of the operation of the elevator installation;

selecting in response to the processing one of a plurality of operational modes of the elevator installation;

generating a control signal for a switch module as a function of the selected operational mode, wherein the switch module has a first port for coupling to the electrical energy storage device, a second port for coupling to the source of alternative energy, a third port for coupling to the electrical power grid and a fourth port for coupling a drive motor of the elevator installation to one of the electrical energy storage device, the source of alternative energy and the electrical power grid, and wherein the control signal causes an energy flow from one of the ports of the switch module to another port of the switch module; and detecting via the parameter indicative of an operation of the elevator installation that the elevator installation is in a standby mode, and controlling the switch module to supply energy from one of the first port and the second port of the switch module to the elevator controller.

12. The method of claim 11, further comprising detecting via the parameter indicative of an operation of the elevator installation that a drive motor of the elevator installation is in a regenerative mode, and controlling the switch module to allow energy flow from the fourth port to one of the first port and the third port of the switch module.

13. The method of claim 12, further comprising detecting via at least the parameter indicative of power available from the source of alternative energy that a surplus of alternative energy is available, and controlling the switch module to allow energy flow from the second port to the third port of the switch module so that alternative energy is fed back to the power grid.

14. A method of managing energy for an elevator installation, comprising:

processing at least one parameter of a group comprising a parameter indicative of a charge status of an electrical energy storage device, a parameter indicative of power available from a source of alternative energy, a parameter indicative of a status of a power grid, and a parameter indicative of an operation of the elevator installation, wherein the processing is performed by a processor having a first input for coupling to the electrical energy storage device, a second input for coupling to the source of alternative energy, a third input for coupling to the electrical power grid, and a forth input for coupling to a controller of the elevator installation to obtain the parameter indicative of the operation of the elevator installation;

selecting in response to the processing one of a plurality of operational modes of the elevator installation; and generating a control signal for a switch module as a function of the selected operational mode, wherein the switch module has a first port for coupling to the electrical energy storage device, a second port for coupling to the source of alternative energy, a third port for coupling to the electrical power grid and a fourth port for coupling a drive motor of the elevator installation to one of the electrical energy storage device, the source of alternative energy and the electrical power grid, and wherein the control signal causes an energy flow from one of the ports of the switch module to another port of the switch module;

detecting via the parameter indicative of an operation of the elevator installation that a drive motor of the elevator installation is in a regenerative mode, and controlling the switch module to allow energy flow from the fourth port to one of the first port and the third port of the switch module;

detecting via at least the parameter indicative of power available from the source of alternative energy that a surplus of alternative energy is available, and controlling the switch module to allow energy flow from the second port to the third port of the switch module so that alternative energy is fed back to the power grid; and detecting via the parameter indicative of an operation of the elevator installation that the elevator installation is in a standby mode, and controlling the switch module to supply energy from one of the first port and the second port of the switch module to the elevator controller.

15. A method of managing energy for an elevator installation, comprising:

processing at least one parameter of a group comprising a parameter indicative of a charge status of an electrical energy storage device, a parameter indicative of power available from a source of alternative energy, a parameter indicative of a status of a power grid, and a parameter indicative of an operation of the elevator installation, wherein the processing is performed by a processor having a first input for coupling to the electrical energy storage device, a second input for coupling to the source of alternative energy, a third input for coupling to the electrical power grid, and a forth input for coupling to a controller of the elevator installation to obtain the parameter indicative of the operation of the elevator installation;

selecting in response to the processing one of a plurality of operational modes of the elevator installation; and generating a control signal for a switch module as a function of the selected operational mode, wherein the switch module has a first port for coupling to the electrical energy storage device, a second port for coupling to the source of alternative energy, a third port for coupling to the electrical power grid and a fourth port for coupling a drive motor of the elevator installation to one of the electrical energy storage device, the source of alternative energy and the electrical power grid, and wherein the control signal causes an energy flow from one of the ports of the switch module to another port of the switch module;

detecting via at least the parameter indicative of power available from the source of alternative energy that a surplus of alternative energy is available, and controlling the switch module to allow energy flow from the second port to the third port of the switch module so that alternative energy is fed back to the power grid; and detecting via the parameter indicative of an operation of the elevator installation that the elevator installation is in a standby mode, and controlling the switch module to supply energy from one of the first port and the second port of the switch module to the elevator controller.

16. The method of claim 11, further comprising detecting via at least the parameter indicative of power available from the source of alternative energy that a surplus of alternative energy is available, and controlling the switch module to allow energy flow from the second port to the third port of the switch module so that alternative energy is fed back to the power grid.

* * * * *